US007766233B2

(12) United States Patent
Haas et al.

(10) Patent No.: US 7,766,233 B2
(45) Date of Patent: Aug. 3, 2010

(54) VOTE BY MAIL ENVELOPE THAT PROTECTS PRIVACY OF VOTER'S SIGNATURE

(75) Inventors: Bertrand Haas, New Haven, CT (US); Douglas B. Quine, Bethel, CT (US); Clare E. Woodman, Norwalk, CT (US); Valentino Guyett, Olympia, WA (US)

(73) Assignee: Pitney Bowes Inc., Stamford, CT (US)

( * ) Notice: Subject to any disclaimer, the term of this patent is extended or adjusted under 35 U.S.C. 154(b) by 871 days.

(21) Appl. No.: 11/646,146

(22) Filed: Dec. 27, 2006

(65) Prior Publication Data

US 2008/0156862 A1 Jul. 3, 2008

(51) Int. Cl.
*G06F 17/00* (2006.01)
*G06K 17/00* (2006.01)

(52) U.S. Cl. ..... 235/386; 235/375

(58) Field of Classification Search ..... 235/386, 235/380, 375, 383, 486, 487, 494; 229/306, 229/80, 300, 305, 301
See application file for complete search history.

(56) References Cited

U.S. PATENT DOCUMENTS

| | | | | |
|---|---|---|---|---|
| 3,186,735 | A | 6/1965 | Hanrahan | |
| 4,597,591 | A | 7/1986 | Gendron et al. | |
| 5,288,994 | A | 2/1994 | Berson | |
| 7,240,835 | B2 | 7/2007 | Brucker et al. | |
| 7,438,213 | B2 * | 10/2008 | Ackley et al. | 229/301 |
| 7,621,450 | B2 * | 11/2009 | Haas | 235/386 |
| 2005/0061866 | A1 * | 3/2005 | Ackley et al. | 229/306 |
| 2007/0095908 | A1 | 5/2007 | Haas et al. | |
| 2008/0121680 | A1 | 5/2008 | Quine et al. | |
| 2008/0136162 | A1 | 6/2008 | Haas et al. | |
| 2008/0142594 | A1 | 6/2008 | Haas et al. | |
| 2008/0143096 | A1 | 6/2008 | Haas et al. | |
| 2008/0156862 | A1 * | 7/2008 | Haas et al. | 229/301 |
| 2008/0314997 | A1 * | 12/2008 | Haas et al. | 235/494 |
| 2009/0159655 | A1 * | 6/2009 | Haas | 235/375 |
| 2009/0160174 | A1 * | 6/2009 | Haas et al. | 283/5 |

* cited by examiner

*Primary Examiner*—Thien M Le
(74) *Attorney, Agent, or Firm*—Brian A. Lemm; Angelo N. Chaclas

(57) ABSTRACT

A vote-by-mail return envelope includes a pouch for receiving a ballot. The pouch is formed from a front sheet and a rear sheet. A signature space is provided to be signed by the voter. The envelope also includes an adhesion region at which the front sheet is adhered to the rear sheet to define a boundary of the pouch. The adhesion region separates the signature space from the pouch. Further, the envelope includes a flap to be attached to at least one of the rear sheet and the front sheet to cover the signature space. The signature space may be on the flap, the rear sheet or front sheet.

23 Claims, 10 Drawing Sheets

VOTE BY MAIL ENVELOPE THAT PROTECTS PRIVACY OF VOTER'S SIGNATURE

FIELD OF THE INVENTION

The invention disclosed herein relates generally to vote by mail systems, and more particularly to an envelope that protects the privacy of signatures on ballots sent through the mail.

BACKGROUND

In democratic countries, governmental officials are chosen by the citizens in an election. Conducting an election and voting for candidates for public office in the United States can be performed in several different ways. One such way utilizes mechanical voting machines at predetermined polling places. When potential voters enter the predetermined polling place, voting personnel verify that each voter is properly registered in that voting district and that they have not already voted in that election. Thus, for a voter to cast his vote, he must go to the polling place at which he is registered, based on the voter's residence. Another method for conducting an election and voting utilizes paper ballots that are mailed to the voter who marks the ballot and returns the ballot through the mail. Mailed ballots have been historically reserved for absentee voting. In the usual absentee voting process, the voter marks the ballot to cast his/her vote and then inserts the ballot in a return envelope which is typically pre-addressed to the voter registrar office in the corresponding county, town or locality in which the voter is registered. The voter typically appends his/her signature on the back of the envelope adjacent his/her human or machine readable identification.

When the return envelope is received at the registrar's office, a voting official compares the voter signature on the envelope with the voter signature retrieved from the registration file to make a determination as to whether or not the identification information and signature are authentic and valid, and therefore the vote included in the envelope should be counted. If the identification and signature are deemed to be authentic and valid, the identifying information and signature are separated from the sealed ballot before it is handed to the ballot counter for tabulation. In this manner, the privacy of the voter's selections is maintained and thus the ballot remains a "secret ballot".

One general problem with vote by mail envelopes is the signature is in the open and exposed for all to see throughout the process for determining whether or not the vote is authentic. This leads to potential privacy issues and concerns, e.g., fraudulent usage of a voter's signature. Some jurisdictions have required that such signatures be hidden from plain sight while the envelope is en route from the voter to the registrar's office. This will protect against easy imaging of the signature, such as, for example, with a hand scanner or digital camera, for later impersonation or other fraudulent purposes, e.g., identity theft. To comply with such requirements, envelopes have been proposed that hide the signature with a flap which is removed when the envelope is received at the registrar's office. These solutions, however, require some mechanical manipulation of the envelopes, which is both expensive and increases the risk of accidental tears of the envelope, potentially leading to damage to the ballots contained in the envelopes, exposing the marked ballot before the conclusion of the authentication process (which in some states require the ballot to be counted, regardless of the outcome of the authentication process), or the ability to link the voter with his/her ballot, thereby removing the secret ballot.

Voting by mail is becoming more prevalent, apart from the usual absentee voting, and in some jurisdictions, entire elections are being conducted exclusively by mail. As the voting by mail becomes more prevalent, the privacy concerns are also more prevalent. Thus, there exists a need for efficient methods and systems that can protect the privacy of signatures on ballots sent through the mail while also reducing the risk of damage to the ballots when the signatures are revealed.

SUMMARY

According to an aspect of the invention, a vote-by-mail envelope includes a pouch for receiving a ballot. The pouch is formed from a front sheet and a rear sheet. The envelope also includes a signature space on one of the front sheet and the rear sheet. The signature space is to be signed by the voter. The envelope further includes an adhesion region at which the front sheet is adhered to the rear sheet to define a boundary of the pouch. The adhesion region separates the signature space from the pouch. In addition the envelope includes a flap to be attached to one or both of the rear sheet and the front sheet to cover the signature space.

The signature space may be on a rear surface of the front sheet, with the front sheet extending beyond the rear sheet to expose the signature space. Alternatively the signature space may be on the rear sheet of the envelope.

The front and rear sheets and the flap may all be formed by folding one or more sheets of paper that have been cut into appropriate shapes and have adhesive applied to them at suitable locations.

The envelope may also include a barcode adjacent the signature space. The barcode may contain data to identify the voter. The barcode may, but need not, be a two-dimensional barcode.

The boundary of the pouch defined by the adhesion region may be at the bottom of the pouch, in which case the signature space is below the pouch. Alternatively, the adhesion region may be at a side of the pouch other than the bottom side. In such a case, the signature space is to the side of the pouch. The flap may close the pouch in addition to covering the signature space.

The envelope may further include a printed pattern adjacent to the signature space. The printed pattern may correspond to a locus at which adhesive on the flap is to contact one of the front and rear sheets adjacent the signature space upon sealing the envelope. This printed pattern may prompt the voter to place his/her signature in the signature space in a location such that the signature will not be marred by adhesive from the flap.

The envelope may be substantially completely opaque at the pouch, and thus transmit substantially no light at the locus of the pouch, while transmitting a substantial amount of light at the locus of the signature space.

According to another aspect of the invention, a method of processing a vote-by-mail return envelope is provided. As in the previous aspect, the envelope includes a pouch formed from a front sheet and a rear sheet. The pouch is for holding a ballot. The envelope also includes a flap which covers the voter's signature on the envelope. The envelope may carry a barcode which identifies the voter and a barcode which identifies the election. These barcodes may be combined in a single barcode containing both sets of data. In addition or alternatively, this information may be represented by machine-readable textual and/or numeric information, such as alphanumeric characters. The method includes reading the barcode on the envelope to identify the voter whose signature is on the envelope. The method further includes shining light through the flap and through at least one of the front and rear sheets to form an image of the signature. The method also includes using the image of the signature to compare the signature with a sample signature that is on record for the identified voter.

The method may further include detaching the signature and the barcode from the pouch. The pouch may remain sealed after the detaching of the signature and the barcode from the pouch. The method may also include opening the sealed pouch and extracting the ballot from the opened pouch.

The reading of the textual information or barcode(s) may occur simultaneously with shining the light through the flap.

According to still another aspect of the invention, there is provided a method of creating a vote-by-mail package to be mailed to a voter. The method includes providing an outbound envelope. The outbound envelope has at least one window formed therein. The method further includes inserting a ballot in the outbound envelope and inserting a return envelope in the outbound envelope. In addition, the method includes printing at least one of a barcode and the name of the voter and a voter identifier (text and/or numerals) on the return envelope while the return envelope is in the outbound envelope. The printing is done through the at least one window in the outbound envelope.

The return envelope may have the characteristics described with reference to the first aspect of the invention set forth above. The barcode and/or the voter's name may be printed on the return envelope at an opposite side of the adhesion region from the above mentioned pouch, and adjacent the above-mentioned signature space. An election-identifying barcode or machine readable textual/numerical information may be printed on the outside of the envelope to facilitate grouping of mixed ballots into the appropriate election groups for subsequent counting and tabulation (if ballots for multiple elections come to a single processing point).

The outbound envelope includes a front panel in which a window or windows may be formed. The barcode and the voter's name may be printed on the return envelope preferably in the same printing operation and preferably with the same print head used to print the voter's name and address on the front panel of the outbound envelope.

According to still another aspect of the invention, a vote-by-mail envelope includes a pouch for receiving a ballot. The pouch is formed from a front sheet and a rear sheet. At least one of the front and rear sheets extends beyond the pouch to form an extension portion. The envelope also includes an adhesion region at which the front sheet is adhered to the rear sheet to define a boundary of the pouch. The adhesion region separates the extension portion from the pouch. The envelope further includes a flap attached on and/or over the extension portion. The flap has a surface which faces the extension portion. The surface of the flap carries a voter's signature. The voter's signature is covered by the extension portion.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The present invention, in certain of its aspects, allows a voter's signature on a vote-by-mail return envelope to be covered with a flap in transit and once received by the registrar, read by a machine without having to tear off or mechanically uncover any flap. The part of the envelope containing the signature and the identity of the voter can easily be cut off without opening the envelope or exposing the ballot, thereby maintaining the secrecy of the ballot. The envelope of the present invention is designed to provide a signature area on an extreme part of the envelope, e.g., the far left (as viewed from the front, although the signature may be on the back) or at the extreme bottom, located where there is nothing written on the front of the envelope, and where there is no obstruction by the ballot contained in the envelope. The signature space is covered with the flap of the envelope, thereby concealing the signature. A high intensity lamp can be used to shine through the signature area and flap, thereby revealing the image of the signature which can then be read. After reading the signature, the entire signature space can be removed from the envelope, without having to open the envelope, thereby removing the link between the voter and the ballot contained in the envelope.

Figure 1:
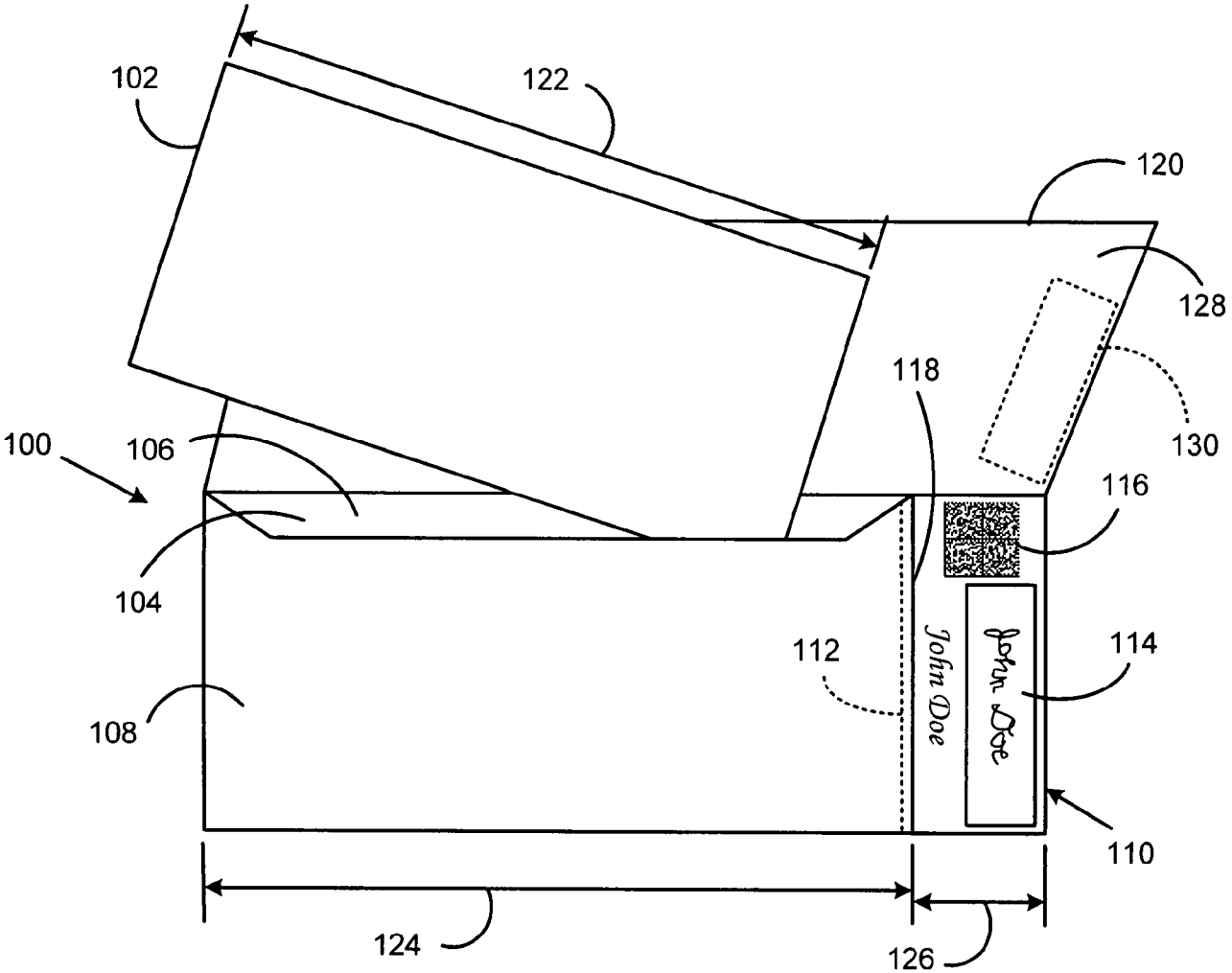
FIG. 1 schematically shows a rear view of a vote-by-mail return envelope provided according to an aspect of the present invention, with a ballot being inserted into a pouch that is part of the return envelope.

FIG. 1 schematically shows a rear view of a vote-by-mail return envelope 100 provided according to an aspect of the present invention, with a ballot 102 being inserted into a pouch 104 that is part of the return envelope 100. As is often the case with an envelope pouch, the pouch 104 of the envelope 100 is formed from a front sheet 106 (of which, in some embodiments, only a small part of its rear side is visible) of the envelope 100 and a rear sheet 108 of the envelope 100. However, the envelope 100 differs from a conventional envelope in part by having an extension portion 110 which extends laterally beyond an end side boundary (indicated approximately by dashed line 112) of the pouch 104. As will be discussed further below, the rear surface of the extension portion 110 carries a signature space 114 to be signed by the voter, and a barcode 116 (in the particular example shown, a two-dimensional barcode), which contains data to identify the voter. The end side boundary 112 of the pouch 104 is defined by an adhesion region (indicated approximately at 118) at which the front sheet 106 is adhered to the rear sheet 108. As seen from FIG. 1, the adhesion region 118 separates the signature space 114 and the barcode 116 from the pouch 104.

The extension portion 110 of the envelope 100 may be formed in a number of ways. For example, the front sheet 106 alone may extend laterally past the adhesion region 118, or the rear sheet 108 alone may extend laterally past the adhesion region 118, or both of the front and rear sheets may extend laterally past the adhesion region. In the first of these three possibilities, the signature space 114 and the barcode 116 may be carried on the rear surface of the front sheet 106. In the latter two of these three possibilities, the signature space and the barcode may be carried on the rear surface of the rear sheet 108. (It may also be the case, even if both sheets extend laterally past the adhesion region 118, that one of the sheets extends further than the other.) If both sheets extend past the adhesion region 118, there may be another adhesion region, which is not separately indicated, to join the sheets together, for example, at the outer edge of the extension portion 110.

The envelope 100 further includes a flap 120 which is sized so as to substantially completely cover the rear surface of the envelope 100 (including the rear surface of the extension portion 110). The flap 120 is located so as to close the pouch 104 of the envelope 100 when the flap/envelope are sealed.

Example dimensions of the envelope 100 will now be described with reference to FIG. 1. In some embodiments, the ballot 102 shown in FIG. 1 may be an 8½ inch by 11 inch sheet that has been tri-folded in the usual manner, thus having a length dimension (indicated at 122) of 8½ inches. To accommodate the ballot 102, the pouch 104 may have a length dimension (indicated at 124) of about 9¼ inches. Further, the extension portion may have a dimension (indicated at 126), measured in the same direction as the length of the pouch 104, of about 2 inches, thereby causing the envelope 100 to have an over-all length of about 11¼ inches. The height of the embodiment of the return envelope shown in FIG. 1 may be, for example, about 4¾ inches. With these dimensions, the return envelope 100 may satisfactorily fit in an outbound envelope (not shown in FIG. 1 but to be described below) to be sent to the voter and having dimensions that do not exceed 6⅛ inches by 11½ inches.

Figure 2:
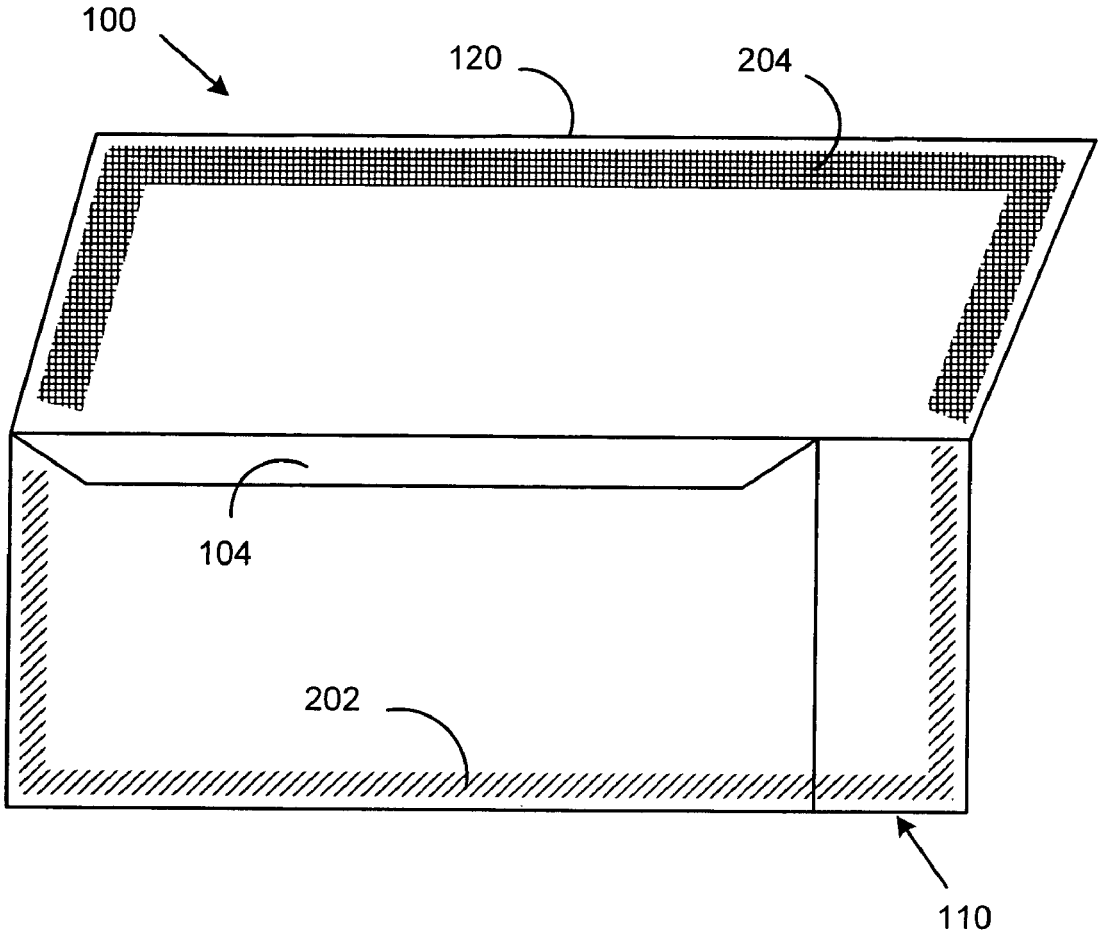
FIG. 2 is another schematic rear view of the vote-by-mail return envelope of FIG. 1, omitting some features thereof, but illustrating another feature as provided according to aspects of the present invention.

Further possible features of the return envelope 100 will now be described with reference to FIGS. 2 and 3. FIG. 2 is another schematic rear view of the return envelope 100, omitting some features thereof. The U-shaped hatched area indicated at 202 in FIG. 2 does not itself directly represent a feature of the envelope 100, but rather is indicative of a locus of the rear surface of the envelope 100 which will be in contact with adhesive on the flap 120 when the flap is sealed to seal the envelope 100 and its pouch 104. (The adhesive itself is indicated as hatched area 204 on the flap 120.) With this arrangement, the flap 120 will, upon sealing of the envelope, be adhered to the rear surface of the envelope along substantially all of both side edges and the bottom edge of the flap 120. Correspondingly, the rear surface of the envelope will be adhered to the flap 120 along substantially all of both side edges and the bottom edge of the rear surface of the envelope 100. With the envelope sealed in this way, the pouch 104 is effectively sealingly closed by the flap 120 and the rear surface of the extension portion 110 of the envelope 100 is also covered by the flap 120, thereby effectively covering from plain view the signature space 114 (indicated by reference numeral in FIG. 1 but not in FIG. 2) carried by the extension portion 110.

Figure 3:
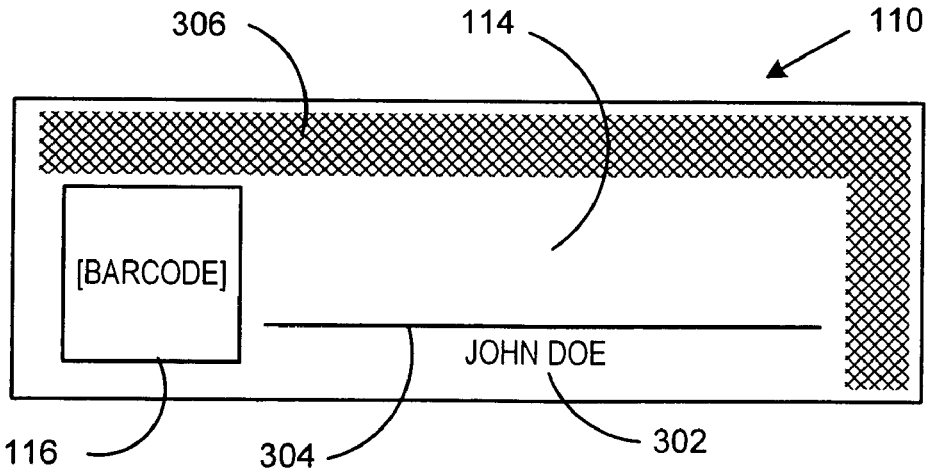
FIG. 3 is a schematic plan view of a signature space and adjoining features provided in certain embodiments of the vote-by-mail return envelope.

FIG. 3 is a schematic plan view of the rear surface of the extension portion 110 (shown in isolation) as provided in accordance with some embodiments of the return envelope 100. The signature space 114 and barcode 116 are shown (the latter indicated schematically), along with the voter's printed name 302 below a signature line 304 in the signature space 114. In addition, there may be a printed pattern (indicated at 306) on the rear surface of the extension portion 110 adjacent the signature space 114. It will be noted that the printed pattern 306 is generally L-shaped and corresponds to the portion of the locus 202 which overlaps with the extension portion 110. Thus the printed pattern 306 is at the locus at which adhesive from the flap 120 (FIGS. 1 and 2, not shown in FIG. 3) will contact the extension portion 110 adjacent the signature space 114 upon sealing of the envelope 100. The presence of the printed pattern 306 may encourage the voter to confine his/her signature to the signature space 114 and to avoid signing the extension portion 110 at a location that may result in the signature being smeared or otherwise adversely affected by adhesive from the flap 120. This may aid in preserving readability of the voter's signature during subsequent processing of the return envelope 100.

In some embodiments, the envelope 100 may be substantially opaque at the locus of the pouch 104 and may transmit a substantial amount of light (at least under suitable conditions) at the locus of the extension portion 110. This may be accomplished, for example, by varying the thickness and/or the composition of a sheet or sheets from which the envelope is formed. More preferably, however, the selective opacity of the envelope 100 may be accomplished by printing a security pattern (which may be a solid pattern) at the locus of the pouch 104 but not at the locus of the extension portion 110. For example, the pattern to opaque the pouch may be printed on any available surface in the light path through the finished envelope and ballot. These surfaces include (a) the rear surface of the rear sheet, (b) the front surface of the rear sheet, (c) the rear surface of the front sheet, (d) the front surface of the flap, (e) the rear surface of the flap, or (f) the rear surface of the ballot. In any case the printed opaque pattern may appear only at the pouch and not at the extension portion. The printing of the pattern may be done before or after folding a sheet to form the pouch. The printing of the pattern may be done at the same time as printing of the address (not shown) of the registrar's office to which the voter will mail the return envelope 100. (It will be appreciated that the address (not shown) of the registrar's office will be present on the front surface (not shown) of the return envelope 100. Of course, the front surface of the envelope 100 is opposite the rear surface that is visible in FIGS. 2 and 3.)

In some embodiments, the return envelope 100, including the front and rear sheets 106, 108 and the flap 120, may all be formed by folding and gluing a single suitable cut sheet (not shown except in folded and glued form).

In the embodiment of the return envelope shown in FIG. 1, the signature space 114 (and the barcode, etc.) are on the extension portion 110 (i.e., on the rear surface of the front sheet 106 or the rear sheet 108, as the case may be). Alternatively, however, one or more of the signature, barcode, etc. may be on what will be the inner surface 128 of the flap 120 when the flap seals the pouch 104. For example, the signature space may be located at the dashed-line rectangle 130 shown in FIG. 1, so that the voter's signature will be covered by the extension portion 110 when the envelope is sealed.

In using the return envelope 100 to vote by mail, the voter may simply mark his/her ballot 102, place it in the pouch 104 of the envelope 100, inscribe his/her signature in the signature space 114 and seal the envelope 100 by adhering the flap 120 to the rear surface of the envelope 100.

Figure 4:
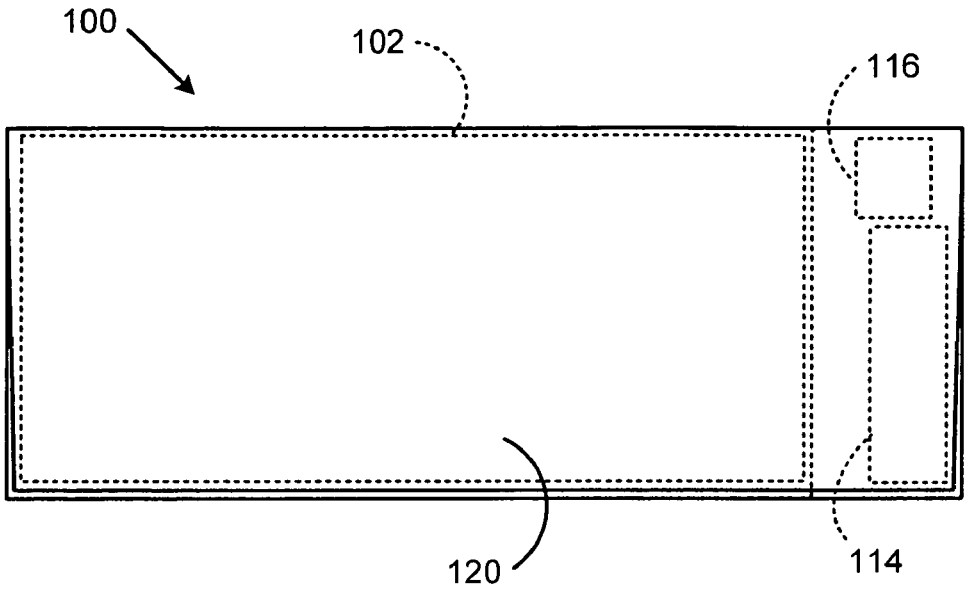
FIG. 4 is a schematic rear view of the vote-by-mail return envelope of FIGS. 1 and 2, showing the condition of the envelope when it is sealed for mailing, and also showing in phantom certain internal features of the sealed envelope.

FIG. 4 is a schematic rear view of the return envelope 100, showing the condition of the envelope when it is sealed for mailing. As seen from FIG. 4, the flap 120 is adhered to the rear surface of the envelope 100 to cover substantially all of the rear surface, including the signature space 114 (shown in phantom) and the barcode 116 (also shown in phantom). Also shown in phantom is the ballot 102 which is contained in the pouch (not separately indicated) of the envelope 100.

Figure 5:
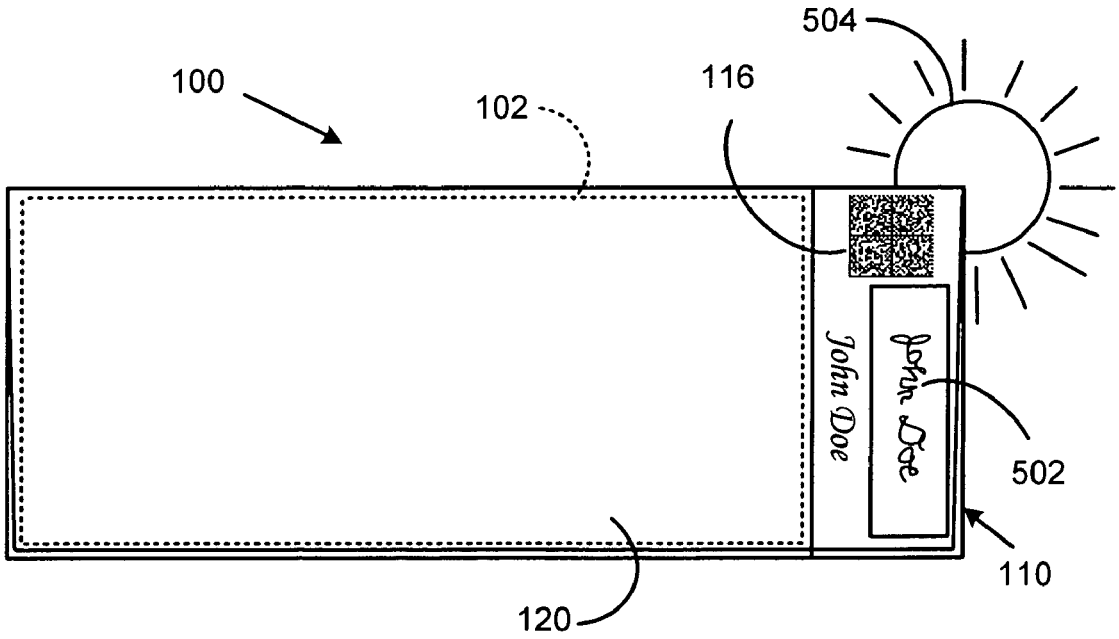
FIG. 5 is a view similar to FIG. 4, schematically illustrating a technique for reading the barcode and the voter's signature after the return envelope is received at the registrar's office and while the envelope remains sealed.

FIG. 5 is a view similar to FIG. 4, schematically illustrating a technique (described in more detail below in connection with FIG. 13) for reading the barcode 116 and the voter's signature 502 after the return envelope 100 is received at the registrar's office and while the envelope remains sealed. FIG. 5 shows the envelope schematically as being illuminated with a lamp 504 to transmit light through the extension portion 110 of the envelope 100 and through the flap 120 at the locus of the extension portion 110. The transmission of the light through the envelope in this manner forms an image of the voter's signature 502 and of the barcode 116 so that both can be read by the registrar's employees and/or by reading equipment that they operate.

Figure 6:
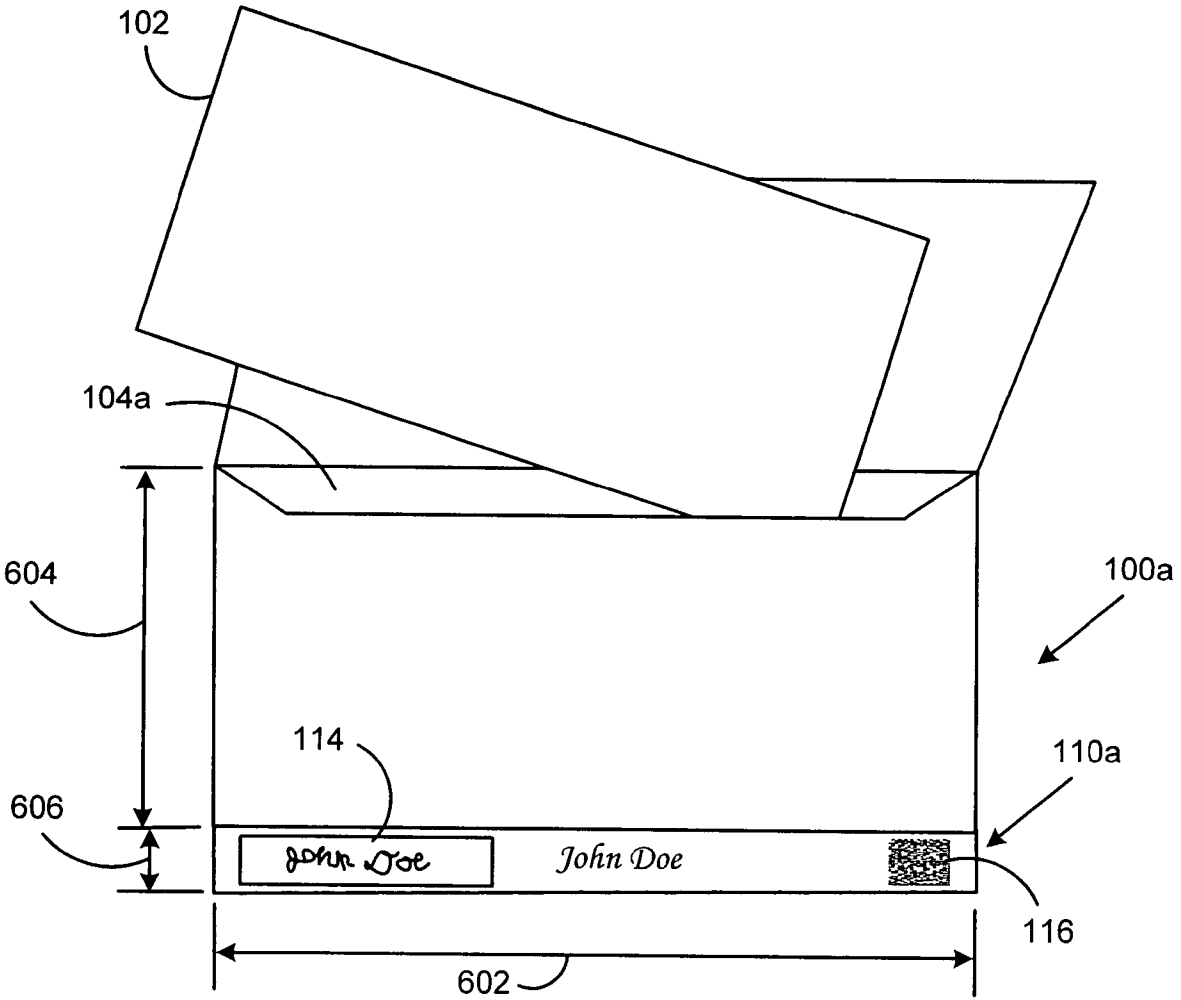
FIG. 6 is a view similar to FIG. 1 of another embodiment of a vote-by-mail return envelope.

FIG. 6 is a view similar to FIG. 1 of another embodiment of a vote-by-mail return envelope. The vote-by-mail return envelope shown in FIG. 6 is generally indicated by reference numeral 100*a*. As in FIG. 1, a ballot 102 is shown in FIG. 6 as it is being inserted into a pouch 104*a* of the return envelope 100*a*. The envelope 100*a* differs from the envelope 100 shown in FIG. 1 in that the envelope 100*a* of FIG. 6 has an extension portion 110*a* that extends downwardly from the bottom of the pouch 104*a*, instead of extending laterally from the side of the pouch, as is the case with the extension portion 110 of the envelope 100 of FIG. 1. Like the extension portion 110 shown in FIG. 1, the extension portion 110*a* shown in FIG. 6 carries a signature space 114 and a barcode 116.

The length dimension (indicated at 602) of the envelope 100*a*, which is also the length dimension of the pouch 104*a*, may be about 9¼ inches in some embodiments. The height dimension (indicated at 604) of the pouch 104*a* may be 4¾ inches in some embodiments. (In other words, the pouch 104*a* may have the same dimensions as the pouch 104 shown in FIG. 1.) The height dimension (indicated at 606) of the extension portion 110*a* shown in FIG. 6 may be about 1 inch, producing an overall height of the envelope of about 5¾ inches. Like the envelope 100 of FIG. 1, the envelope 100*a* of FIG. 6 may thus be dimensioned to fit in an outbound envelope that is within the postal size limits for a letter-sized envelope.

Figure 7:
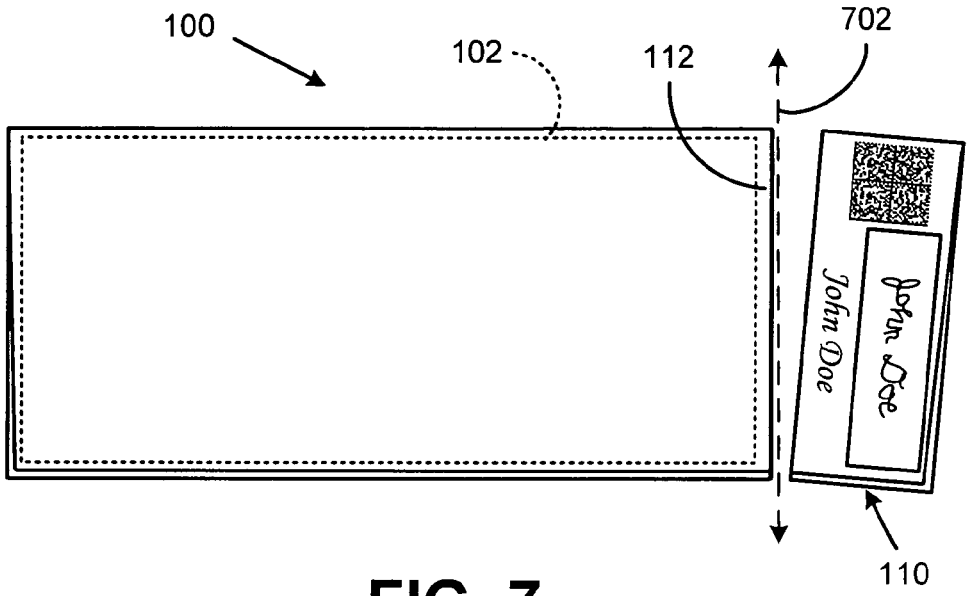
FIG. 7 is a view similar to FIGS. 4 and 5, schematically illustrating a technique for detaching identifying information from the ballot contained within the return envelope.

Considering again the envelope 100 described above with reference to FIG. 1, FIG. 7 is a view similar to FIGS. 4 and 5, and schematically illustrates a technique for detaching identifying information from the ballot 102 (indicated in phantom) contained within the return envelope 100. In particular, after the barcode has been read and the signature verified from the extension portion 110, the extension portion may be detached from the pouch 104 and the ballot 102, by cutting the envelope from top to bottom (as indicated schematically at 702) just outside the boundary 112 of the pouch 104.

Figure 8:
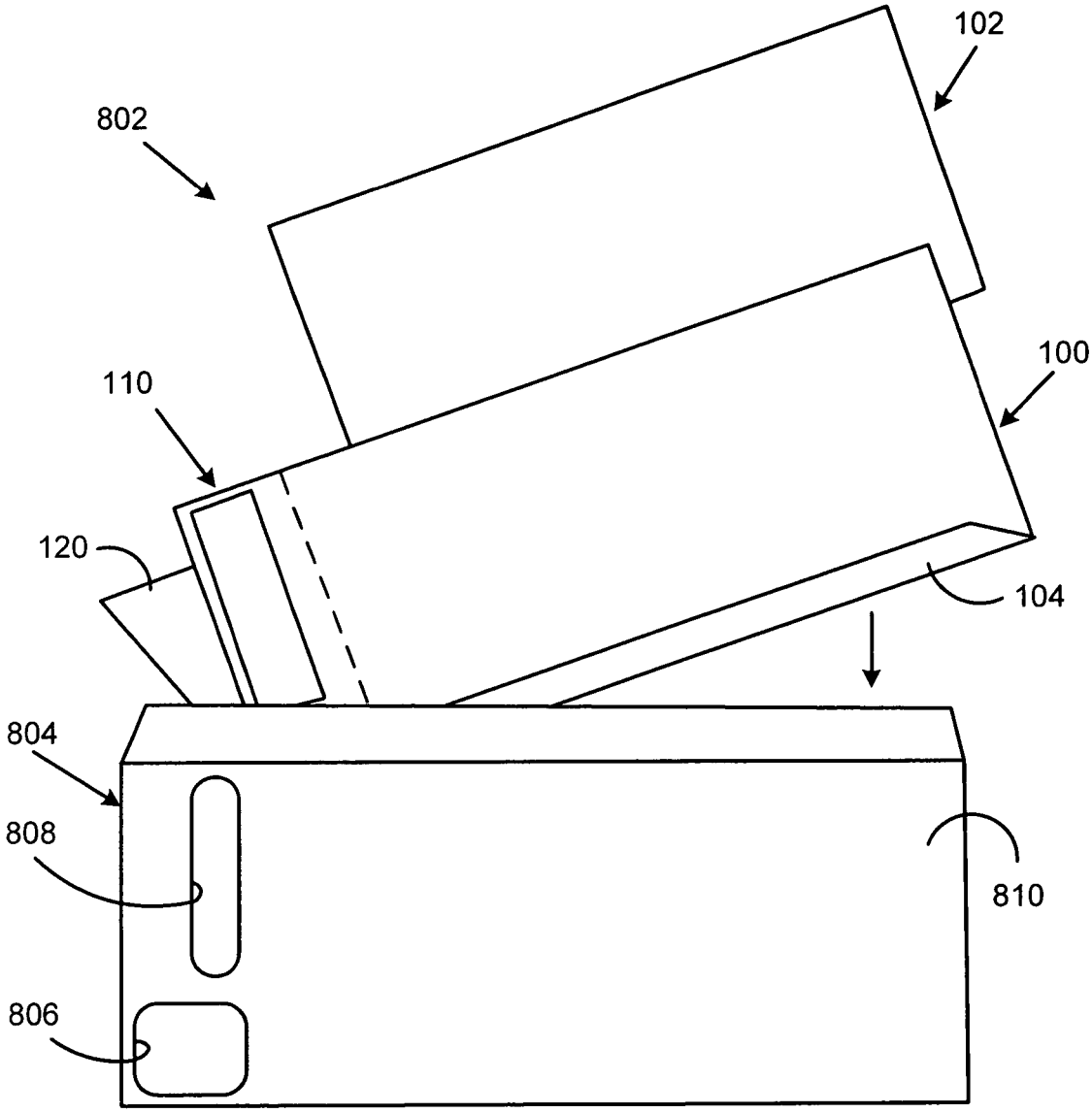
FIG. 8 schematically illustrates a process provided in accordance with an aspect of the invention for assembling a vote-by-mail package to be sent to a voter.

FIG. 8 schematically illustrates a process provided in accordance with an aspect of the invention for assembling a vote-by-mail package 802 to be sent to a voter. The vote-by-mail package 802 may include the above-mentioned return envelope 100 and ballot 102, both shown being inserted in an outbound envelope 804, which is also part of the vote-by-mail package. As seen from FIG. 8, the outbound envelope 804 may have windows 806 and 808 formed at the left side of the front panel 810 of the outbound envelope 804.

As illustrated in FIG. 8, the return envelope 100 may be inserted in the outbound envelope 804 in such a manner that (a) the pouch 104 and extension portion 110 of the return envelope 100 are adjacent the front panel 810 of the outbound envelope 804, (b) the flap 120 of the return envelope 100 is folded backwards against the front (not visible in the drawings) of the return envelope 100, and (b) the extension portion 110 of the return envelope is directly behind the windows 806, 808 in the front panel 810 of the outbound envelope 804. It will also be noted that prior to insertion of the return envelope 100 in the outbound envelope 804, the barcode and the voter's name have not yet been printed on the extension portion 110. Thus, immediately after insertion of the return envelope 100 and the ballot 102 in the outbound envelope 804, the vote-by-mail package 802 has not yet been "personalized" (i.e., caused to carry information specific to a certain voter).

Figure 9:
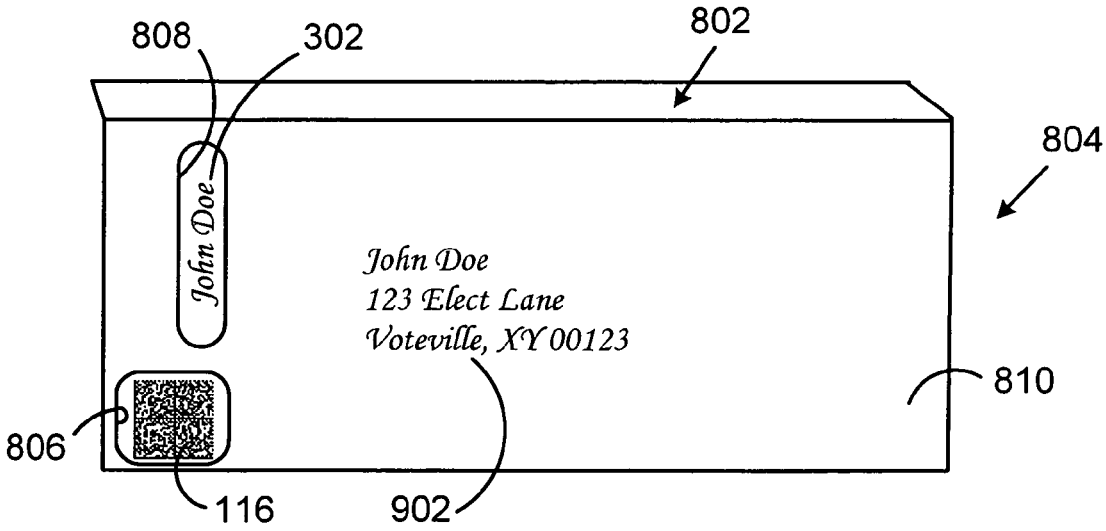
FIG. 9 is a front view of the vote-by-mail package of FIG. 8, after printing on the package to indicate the specific voter for which the package is intended.

As suggested by FIG. 9, personalization of both the outbound envelope 804 and the return envelope 100 may be performed in a single printing step, in which: (a) the voter's mailing address 902 may printed on the front panel 810 of the outbound envelope 804, (b) the voter's name 302 may be printed through the window 808 on the extension portion 110 of the return envelope 100, and (c) the barcode 116 may be printed through the window 806 on the extension portion 100 of the return envelope 100.

In another embodiment, not illustrated in FIGS. 8 and 9, the return envelope may be inserted in the outbound envelope with the backward-folded flap of the return envelope facing the window(s) in the outbound envelope, to allow the barcode, etc. to be printed (e.g., in the same operation with printing the voter's address on the outbound envelope) on what will be, upon mailing of the return envelope, the inner surface of the flap of the return envelope.

Figure 10:
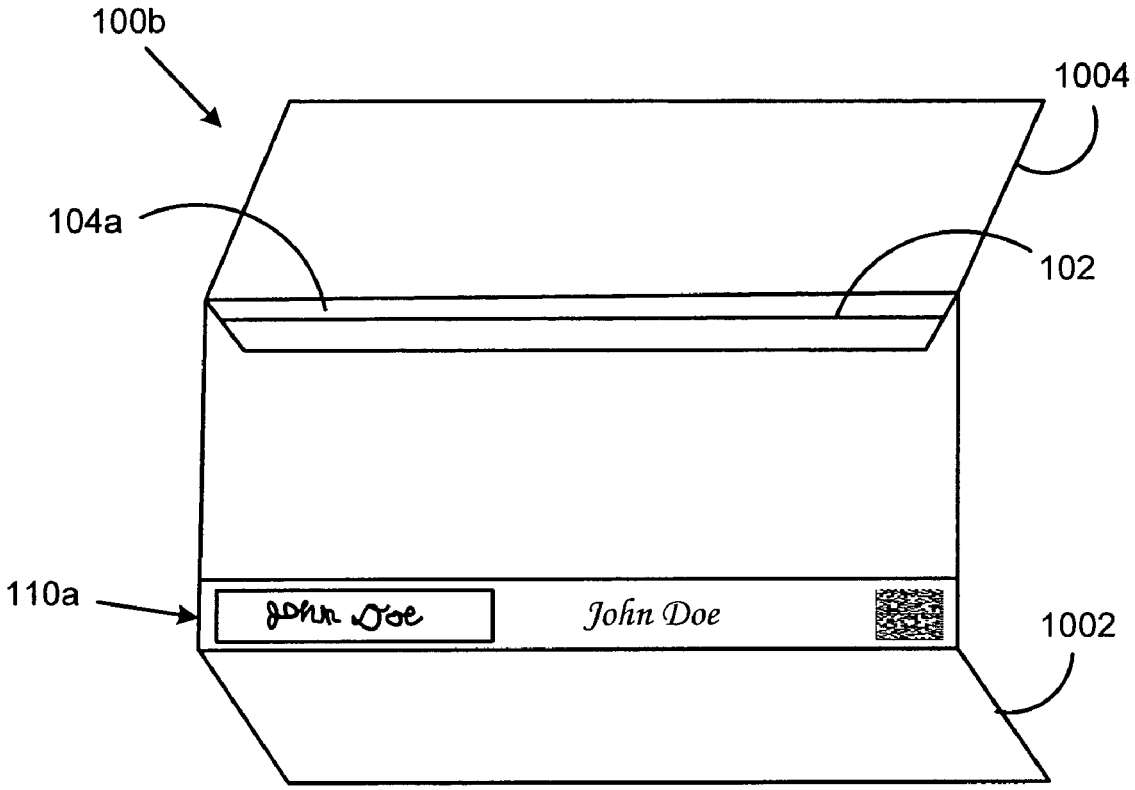
FIG. 10 is a schematic rear view of yet another embodiment of a vote-by-mail return envelope.

FIG. 10 is a schematic rear view of yet another embodiment of a vote-by-mail return envelope. The vote-by-mail-return envelope of FIG. 10 is generally indicated by reference numeral 100*b*. The envelope 100*b* of FIG. 10 resembles the envelope 100*a* of FIG. 6, in that the envelope 100*b* has an extension portion 110*a* below its pouch 104*a*. However, the envelope 100*b* has two flaps—a lower flap 1002, and an upper flap 1004—instead of the single flap of the envelope 100*a* of FIG. 6. The flap 1002 may be closed first (FIGS. 11 and 12) and sealed to the back of the envelope, to protect the voter's signature and identifying information. The flap 1004 may be closed and sealed next to protect the ballot 102. When the extension portion is cut off at the registrar's office after verifying the signature (in similar manner to the technique illustrated in FIG. 5), the upper flap 1004 may remain in place, without being cut or otherwise disturbed, pending opening of the envelope to access the ballot inside.

An advantage that may be offered by the two flap envelope 100*b* is that it may avoid bringing any adhesive from a flap close to the signature space on the extension portion.

Figure 11:
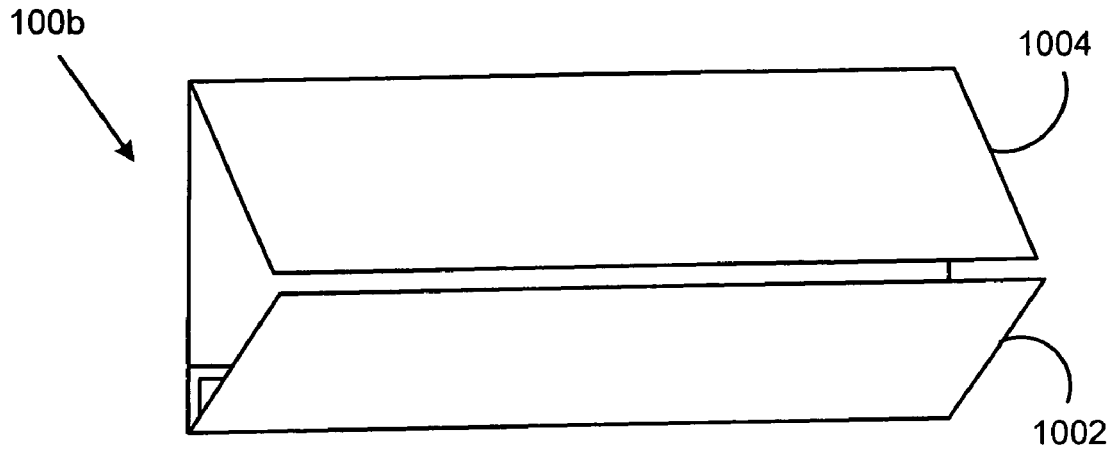
FIG. 11 is another schematic rear view of the envelope of FIG. 10, showing top and bottom flaps of the envelope partially moved to their sealed positions.
Figure 12:
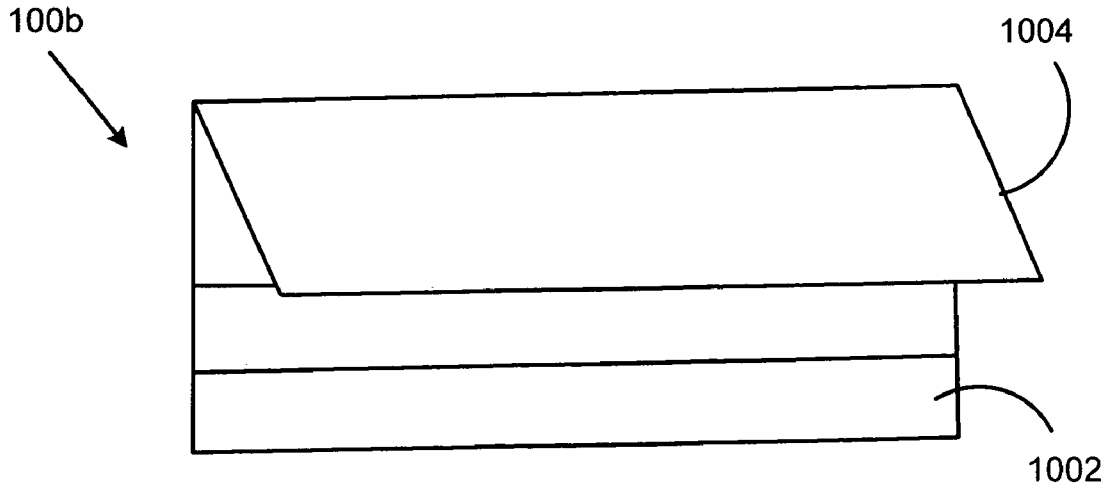
FIG. 12 is still another schematic rear view of the envelope of FIGS. 10 and 11, showing the bottom flap in its sealed position and the top flap partially moved to its sealed position.

In still another embodiment, the return envelope 100*b* of FIGS. 10-12 may be modified by reducing the length of the flaps (i.e. the direction transverse to the long dimension of the envelope). For example, flap 1004, as modified, need only be long enough to satisfactorily seal the pouch 104*a*, whereas flap 1002, as modified, need only be long enough to cover the voter's signature, while keeping glue (not shown) on the edge of the modified flap 1002 clear of the signature.

Figure 13:
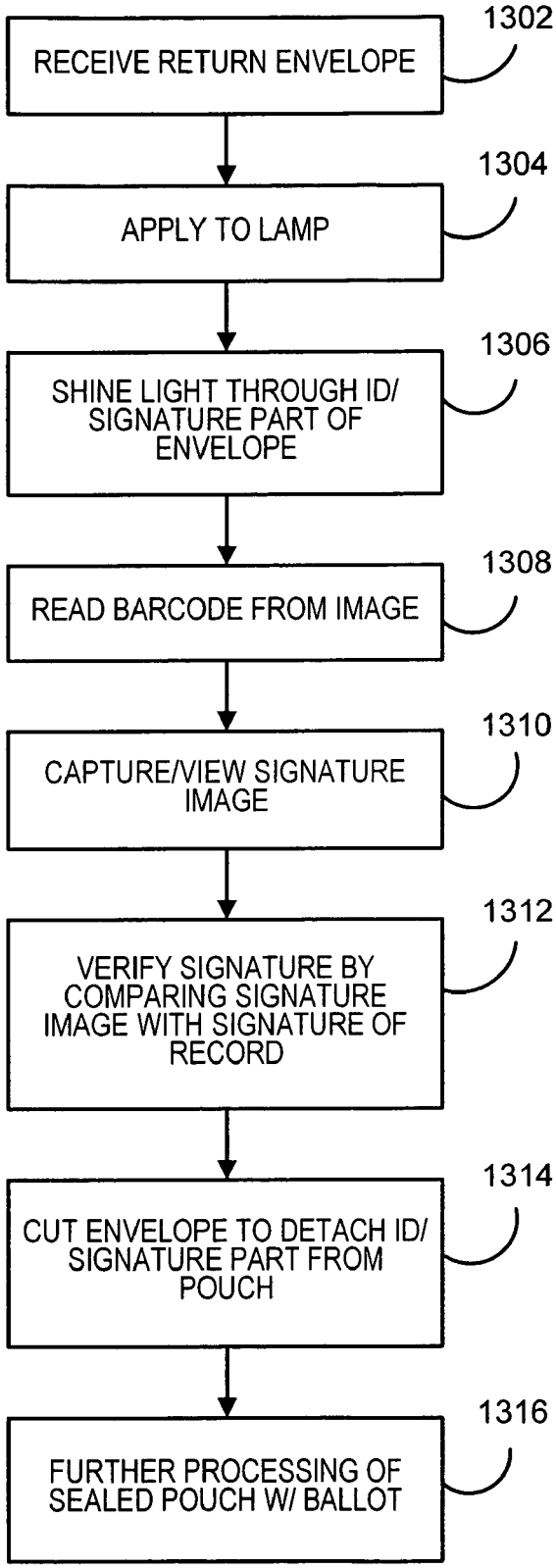
FIG. 13 is a flow chart that illustrates a process provided according to an aspect of the invention for processing a vote-by-mail return envelope after the envelope is received by the voting registrar from the voter.

FIG. 13 is a flow chart that illustrates a process provided according to an aspect of the invention for processing a vote-by-mail return envelope after the envelope is received by the voting registrar from the voter. (The terms "voting registrar" or "registrar" as used herein should be understood to refer to any organization that processes, verifies and/or counts ballots mailed in by voters.)

At 1302 in FIG. 13, a return envelope 100 (or 100*a* or 100*b*), presumably with a ballot 102 inside, is received at the registrar's office. Perhaps after initial processing, such as verification of a postmark, the return envelope is applied (step 1304) to a high intensity lamp, as schematically illustrated for example at FIG. 5. In some embodiments, for superior results, the return envelope may be pressed directly against the lamp, with the extension portion (presumably carrying the voter's signature) directly in front of the lamp.

Assuming that the lamp is on at the time of step 1304, step 1304 results in light shining (step 1306) through the signature space of the extension portion and also through the locus of the barcode or text/numerals which identify the voter. Consequently, if the voter has signed the signature space, an image of the voter's signature is formed by the light shining through the signature space. Similarly, an image of the barcode/text/numerals is formed. By using suitable imaging apparatus, the barcode image may be captured, allowing the barcode to be read (step 1308) to identify the voter who sent in the envelope, and the signature image may also be captured (step 1310). The voter's signature that is on record with the registrar may then be called up, to allow comparison of the record signature and the signature represented by the signature image from the envelope. As a result of this comparison (which may be by human operator and/or by machine image analysis), the voter's signature on the envelope may be verified (step 1312). At this point, the validity of the ballot may be considered to have been determined (at least in regard to examination of the return envelope), and the identifying information (i.e., the signature, barcode and voter's name) may now be detached from the pouch/ballot, by cutting off the extension portion (step 1314).

From this point onward, as indicated at 1316, the ballot may be processed in a conventional manner, including storing the sealed envelope with other sealed valid ballot return envelopes, subsequently opening the envelope, and counting the ballot.

As an alternative, or as a preliminary, to reading the barcode at step 1308 via light shining through the envelope, a barcode printed on the outside of the return envelope (or visible through a window in the envelope flap), or identifying information in the form of alphanumeric characters may be directly read (i.e., by light shining on the outside of the envelope but not therethrough) to identify one or more of the voter who sent in the return envelope or the election to which it pertains. This may be done, for example, between steps 1302 and 1304, and would allow for sorting of envelopes by election, in the case where ballots for more than one election are returned to a central location.

Figure 14:
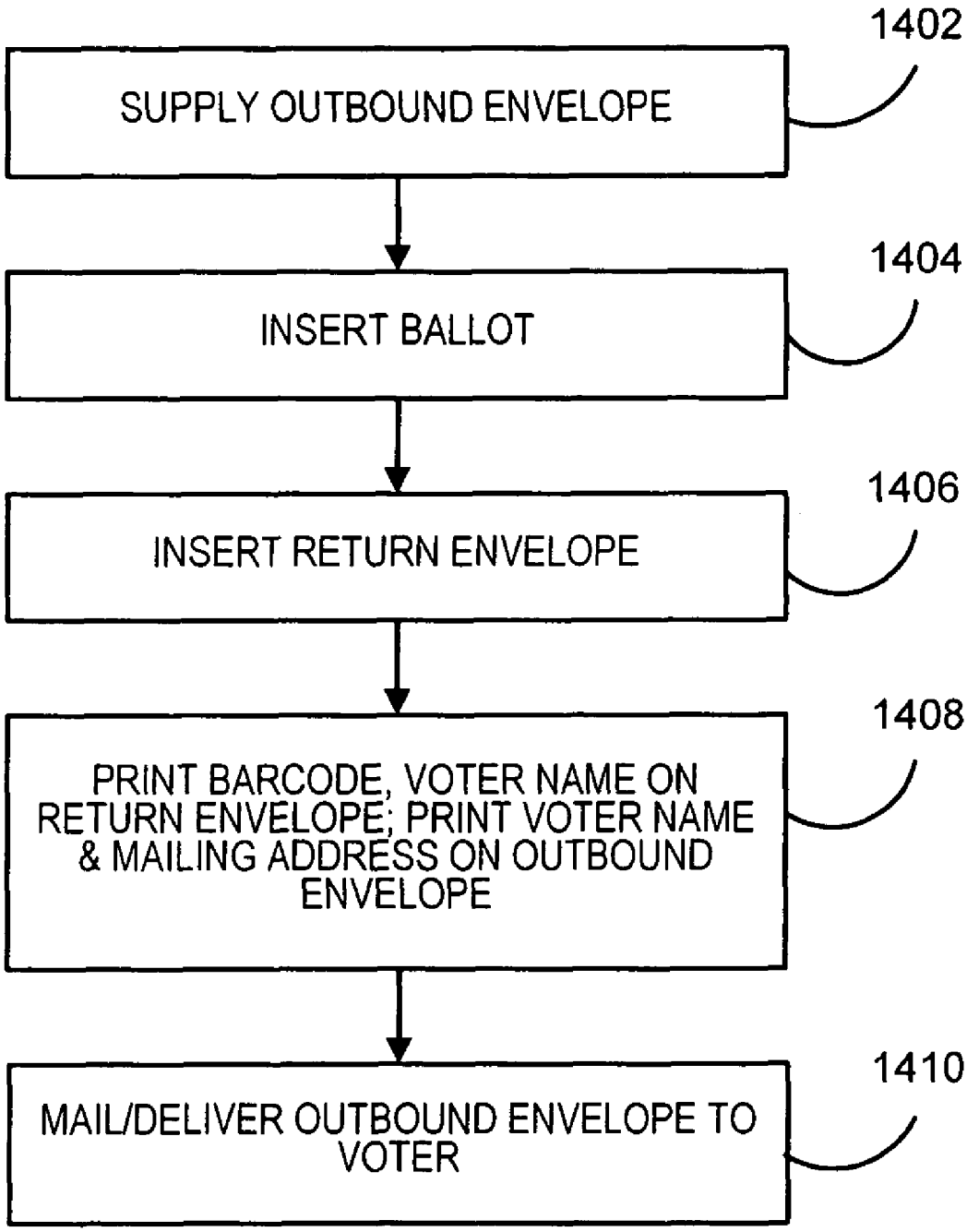
FIG. 14 is a flow chart that illustrates a process provided according to an aspect of the invention for assembling a vote-by-mail package to be sent to a voter.

FIG. 14 is a flow chart that illustrates a process provided according to an aspect of the invention for assembling a vote-by-mail package (e.g., as illustrated in FIGS. 8 and 9) to be sent to a voter.

At 1402, the outbound envelope 804 is made available to have the other items inserted therein. At 1404, the ballot 102 is inserted in the outbound envelope 804. At 1406, the return envelope 100 is inserted in the outbound envelope 804. (It should be understood that the order of steps 1404 and 1406 may be reversed, or the steps may be combined, so long as the suitable parts of the extension portion 110 of the return envelope 100 end up exposed to the windows 806, 808 of the outbound envelope 804.)

At 1408, the voter's name and address are printed on the front panel 810 of the outbound envelope 804; preferably as part of the same printing operation, and by the same printhead, the barcode is printed through the window 806 on the extension portion of the return envelope, and the voter's name is printed through the window 808 on the extension portion of the return envelope. At 1410 the outbound envelope and its contents are mailed or otherwise delivered to the voter.

The above description, and the flow charts herein, are not meant to imply a fixed order of the enumerated process steps. Rather, the process steps may be performed in any order that is practicable and/or various of the steps may be combined with each other or performed partly or entirely simultaneously with each other.

According to another alternative embodiment of the return envelope, a window may be provided in the flap of the return envelope at the locus of the barcode or voter-identifying text/numerals to allow the barcode/text/numerals to be read directly rather than by shining a light through the envelope. In addition or alternatively voter identifying text/numerals and/or a barcode may be printed on the outside of the return envelope for reading with direct light. In either case, direct reading of the barcode or identifying text/numeral may be more convenient than reading an image of such information formed by shining light through the envelope.

In some embodiments, the front of the return envelope may be treated at the locus of the extension portion, to prevent ink smudges or dirt, etc., from adhering at that locus so as to interfere with subsequent reading of the signature and/or the barcode. The treatment may be with polymer, wax, Teflon or the like. In addition or alternatively, a like treatment may be made to the outer surface of the flap at the locus of the extension portion.

In some embodiments, the flap may be formed of a tamper-indicating paper, of a known type, to prevent undetected tampering with the return envelope, the signature or the ballot.

In some embodiments, the voter may be instructed to apply a self-adhesive layer of transparent plastic over his/her signature, to protect the signature in the event that it is necessary to remove the flap to forensically examine the signature. In some embodiments, the plastic layer may be incorporated with the flap.

A number of embodiments of the present invention have been described. Nevertheless, it will be understood that various modifications may be made without departing from the spirit and scope of the invention. Other variations relating to implementation of the functions described herein can also be implemented. Accordingly, other embodiments are within the scope of the following claims.

What is claimed is:

1. A vote-by-mail return envelope comprising:

a pouch for receiving a ballot, the pouch formed from a front sheet and a rear sheet;

a signature space for a voter's signature on one of said front sheet and said rear sheet;

an adhesion region at which said front sheet is adhered to said rear sheet to define a boundary at one of a bottom side of said pouch or a side of said pouch that is not the bottom side, said adhesion region separating said signature space from said pouch; and a flap to be attached to at least one of said rear sheet and said front sheet to cover said signature space.

2. The vote-by-mail return envelope according to claim 1, wherein said signature space is on a rear surface of said front sheet, said front sheet extending beyond said rear sheet to expose said signature space.

3. The vote-by-mail return envelope according to claim 1, wherein said signature space is on said rear sheet.

4. The vote-by-mail return envelope according to claim 1, wherein said front and rear sheets were formed by folding a single sheet of paper.

5. The vote-by-mail return envelope according to claim 4, wherein said flap was formed by folding said single sheet of paper.

6. The vote-by-mail return envelope according to claim 1, further comprising:

a barcode adjacent said signature space, said barcode containing data to identify at least one of (a) the voter, and (b) an election to which the ballot pertains.

7. The vote-by-mail return envelope according to claim 6, wherein the barcode is a two-dimensional barcode.

8. The vote-by-mail return envelope according to claim 1, wherein said flap is for closing said pouch.

9. The vote-by-mail return envelope according to claim 1, further comprising:

a printed pattern adjacent said signature space, said printed pattern corresponding to a locus at which adhesive at said flap is to contact one of said front and rear sheets adjacent said signature space upon sealing the envelope.

10. The vote-by-mail return envelope according to claim 1, wherein substantially no light is transmitted through said pouch and a substantial amount of light is transmitted through said signature space.

11. A method of processing a vote-by-mail return envelope comprising a pouch formed from a front sheet and a rear sheet, said pouch containing a ballot, said envelope also comprising a flap covering a voter's signature on said envelope, said envelope carrying a barcode or machine-readable textual/numerical information, the method comprising:

reading the barcode or machine-readable textual/numerical information on the envelope to identify the voter whose signature is on the envelope;

shining light through the flap and through at least one of said front and rear sheets to form an image of said signature; and using the image to compare the signature with a sample signature that is on record for the identified voter.

12. The method according to claim 11, further comprising:

detaching said signature and said barcode or machine-readable textual/numerical information from said pouch.

13. The method according to claim 12, wherein said pouch remains sealed after said detaching step.

14. The method according to claim 13, further comprising:

opening said sealed pouch and extracting said ballot from said opened pouch.

15. The method according to claim 11, wherein said reading of said barcode or machine-readable textual/numerical information occurs simultaneously with said shining of said light through said flap.

16. The method according to claim 11, further comprising:

pressing the envelope against a lamp while shining the light through the flap.

17. A method of creating a vote-by-mail package to be mailed to a voter, the method comprising:

providing an outbound envelope, the outbound envelope having at least one window formed therein;

inserting a ballot in the outbound envelope;

inserting a return envelope in the outbound envelope; and printing at least one of a barcode and the name of the voter on the return envelope while the return envelope is in the outbound envelope, the printing being done through the at least one window in the outbound envelope.

18. The method according to claim 17, wherein the return envelope includes a pouch for receiving the ballot after the ballot is marked by the voter, the pouch formed from a front sheet and a rear sheet; a signature space on one of said front sheet and said rear sheet, said signature space for being signed by the voter; an adhesion region at which said front sheet is adhered to said rear sheet to define a boundary of said pouch, said adhesion region separating said signature space from said pouch; and a flap to be attached to at least one of said rear sheet and said front sheet to cover said signature space; wherein said printing said at least one of said barcode and said voter's name further comprises:

printing said at least one of said barcode and said voter's name on said return envelope at an opposite side of said adhesion region from said pouch, and adjacent said signature space.

19. The method according to claim 17, wherein the return envelope includes a pouch for receiving the ballot after the ballot is marked by the voter and a flap for closing the pouch, the flap in a backward-folded position to leave the pouch open, wherein said printing said at least one of said barcode and said voter's name further comprises:

printing said at least one of said barcode and said voter's name on a surface of said flap, said surface facing away from said pouch when said flap is in said backward-folded position.

20. The method according to claim 17, wherein the outbound envelope includes a front panel in which said at least one window is formed, said barcode and voter's name or a number identifying said voter being printed on said return envelope with a print head that prints the voter's name and mailing address on the front panel of the outbound envelope.

21. A vote-by-mail return envelope comprising:

a pouch for receiving a ballot, the pouch formed from a front sheet and a rear sheet, at least one of said front and rear sheets extending beyond said pouch to form an extension portion;

an adhesion region at which said front sheet is adhered to said rear sheet to define a boundary at one of a bottom side of said pouch or a side of said pouch that is not the bottom side, said adhesion portion separating said extension portion from said pouch; and a flap attached on and/or over said extension portion, said flap having a surface which faces said extension portion, said surface of said flap carrying a voter's signature, said voter's signature covered by said extension portion.

22. The vote-by-mail return envelope according to claim 21, wherein said flap closes said pouch.

23. The vote-by-mail return envelope according to claim 21, wherein said front sheet, said rear sheet and said flap are formed by folding a single sheet of paper.

* * * * *